US005531081A

United States Patent [19]

Savkar et al.

[11] Patent Number: 5,531,081

[45] Date of Patent: Jul. 2, 1996

[54] TWO PIECE LAUNDRY ADDITIVE DISPENSER CUP

[75] Inventors: Sudhir D. Savkar, Schenectady, N.Y.; Brain D. Lisek, Louisville, Ky.; Robert E. Sundell, Clifton Park, N.Y.

[73] Assignee: General Electric Company, Schenectady, N.Y.

[21] Appl. No.: 379,041

[22] Filed: Jan. 27, 1995

[51] Int. Cl.[6] ..... D06F 39/02

[52] U.S. Cl. ..... 68/17 A

[58] Field of Search ..... 68/17 A

[56] References Cited

U.S. PATENT DOCUMENTS

| | | | |
|---|---|---|---|
| 3,330,135 | 10/1965 | Douglas | 68/17 A X |
| 3,481,163 | 12/1969 | Bochan et al. | 68/17 A X |
| 3,596,480 | 8/1971 | Douglas | 68/17 A |
| 3,620,054 | 11/1971 | Drews et al. | 68/17 A |
| 3,699,785 | 10/1972 | Waugh | 68/17 A |
| 3,736,773 | 6/1973 | Waugh | 68/17 A |
| 4,118,957 | 10/1978 | Marcussen | 68/17 A |
| 4,186,573 | 2/1980 | Brenner et al. | 68/17 R X |
| 4,186,574 | 2/1980 | Sundstrom | 68/17 A |
| 4,240,277 | 12/1980 | Manthei | 68/17 A |
| 4,379,515 | 4/1983 | Townsend | 68/17 R X |
| 4,478,059 | 10/1984 | Yates | 68/17 A |

*Primary Examiner*—Philip R. Coe

*Attorney, Agent, or Firm*—Patrick K. Patnode; Donald S. Ingraham

[57] ABSTRACT

A novel dispenser cup which may be employed in washing machines or other mechanical devices. More particularly, this dispenser cup mechanism comprises a top cap fixedly positioned above a bottom cup. This dispenser cup uses a parabolic shape in order to fully dispense a laundry additive placed within.

6 Claims, 3 Drawing Sheets

TWO PIECE LAUNDRY ADDITIVE DISPENSER CUP

BACKGROUND OF THE INVENTION

This invention relates generally to a novel dispenser cup which may be employed in mechanical apparatuses, most often washing machines. More particularly, said mechanism comprises a top cap positioned above a bottom cup. Said dispenser cup is capable of fully dispensing a laundry additive placed therein.

A number of patent references describe dispensers which use centrifugal force developed by a washing machine during a spin phase to effect release of a laundry additive which is most effective in the rinse cycle. As used herein, "laundry additive" refers to any composition added to enhance the cleanliness, sanitation or aesthetics of fabrics, and includes, but is not limited to fabric softeners, detergents, whiteners, antistat agents, bleaches, bleach activators, anti-redeposition agents, enzymes and mixtures of the foregoing.

In several of these related art patents, laundry additive dispensers are mounted on an agitator post to use centrifugal force to transfer an additive from a reservoir compartment to a release compartment. At the same time, a washing tub and an agitator are rotating to spin out wash water. As the agitator comes to a stop at the end of a spin cycle, the laundry additive drains into the tub. Dispensers of this type are disclosed, for example, by U.S. Pat. No. 4,240,277 issued to Manthei; U.S. Pat. No. 4,186,574 issued to Sundstrom; U.S. Pat. No. 4,118,957 issued to Marcussen; U.S. Pat. No. 3,736,773, and U.S. Pat. No. 3,699,785 both issued to Waugh; U.S. Pat. No. 3,620,054 issued to Drews et al: U.S. Pat. No. 3,596,480 and U.S. Pat. No. 3,330,135 issued to Douglas; U.S. Pat. No. 3,481,163 issued to Bochan et al: and U.S. Pat. No. 4,478,059 issued to Yates.

Other dispensers which utilize centrifugal force to release an additive but which are not attached to the agitator include U.S. Pat. No. 4,379,515 issued to Townsend, which describes a free body dispenser having a balloon-like additive reservoir which releases additive under pressure generated by spin phase centrifugal forces, especially if the reservoir is sandwiched between a laundry load and the sidewall of the machine. Brenner et al, U.S. Pat. No. 4,186,573 describes a centrifugally-actuated two-chamber dispenser which hangs on the rim of the wash tub. Operation of the device of Brenner et al is similar to the agitator-mounted two-chamber dispensers, i.e., centrifugal fill of an outer chamber and gravity flow after the spin ceases.

The dispenser cup disclosed within this application has several advantages over the before mentioned related art dispenser cups. First, most of the related art dispenser cups cannot fully dispense all of the laundry additive during a spin phase. This results in the retention of a significant additive residue in the cup at the end of operation. Such a result is undesirable because of the unsightly appearance of the residue in the cup which must ultimately be cleaned out by the user/consumer.

Furthermore, many of the related art dispenser cups have complex surface undercuts and require the use of complex and expensive clamshell type molds when using a plastic molding material. This results in extra time and money being expended during the manufacturing process and ultimately increasing the overall product cost. Furthermore, several of the related art dispenser cups need a substantial amount of cooling time, further increasing the manufacturing costs.

Accordingly, there is a need for an improved dispenser cup which fully dispenses its contents during use and can easily and quickly be molded during manufacturing. This improved dispenser cup would solve the problem of residue buildup, save time and cost during manufacturing, and inevitably create an overall cost savings for the consumer. It is the purpose of this invention to fulfill these and other needs in the art in a manner more apparent to the skilled artisan once given the following disclosure.

SUMMARY OF THE INVENTION

The above-mentioned needs are met by the present invention which relates to a novel dispenser cup which is often used with washing machines for dispensing laundry additives, frequently a fabric softener. More particularly, the instant apparatus comprises a top cap fixedly positioned above a bottom cup. This novel apparatus provides a simple, clean, and cost effective means of dispensing laundry additives.

In certain preferred embodiments, the top cap and the bottom cup may be formed using a single draw mold, a process which is much more efficient and cost effective than a conventional method which utilizes an expensive clamshell type molding device.

Furthermore, a certain preferred embodiment would incorporate a thin walled, readily moldable design which would require the part thickness of the bottom cup and the top cap to be nearly uniform to allow the design to be readily cooled within the mold, thereby saving time and money during the manufacturing process.

Furthermore, the instant invention utilizes parabolic design parameters in a section of the bottom cup. This type of design was determined using the first principle of hydrostatics, and is capable of fully dispensing a material during rotation. This would result in an improved dispenser cup which would not have residue build-up and would not require frequent clean up by the user/consumer.

Other objects and advantages of the present invention will become apparent upon reading the following detailed description and the appended claims with reference to the accompanying drawings.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
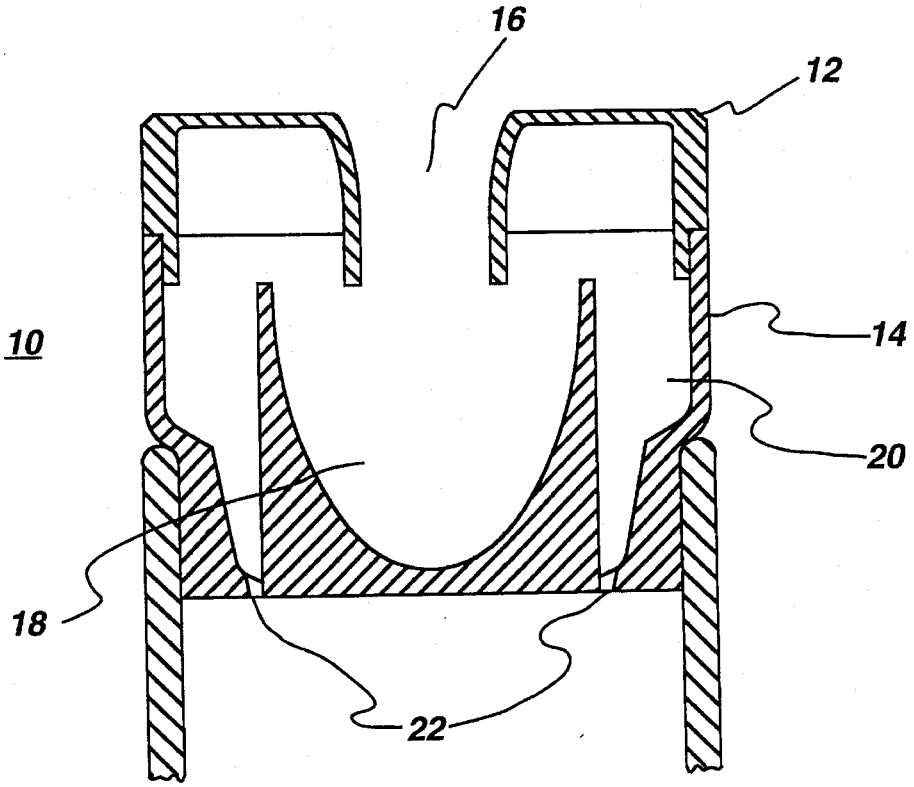
FIG. 1 is a cross-sectional view along the vertical axis of the instant invention.

Referring now to FIG. 1, a novel dispenser cup 10 is depicted which is frequently employed within a washing machine assemblage, wherein said dispenser cup 10 dispenses laundry additives during a spin cycle. Said dispenser cup 10 is comprised of a top cap 12 fixedly positioned above a bottom cup 14.

Said top cap 12 is generally cylindrical in shape having an inlet 16, wherein said inlet 16 fluidly connects said top cap 12 with said bottom cup 14 such that laundry additive may be introduced to said dispenser cup 10.

Said top cap 12 and said bottom cup 14 may be made from a specified material which is capable of being simply cast in a single draw mold. The preferred material is often plastic such as polypropylene. In a most preferred embodiment, said top cap 12 and said bottom cup 14, are thin walled and have a relatively uniform wall thickness.

Said bottom cup 14 is often rigidly attached to an agitator within a washing machine assemblage and is comprised of an inner chamber 18 and an outer chamber 20. Said inner chamber 18 having outwardly sloping walls capable of holding a laundry additive. Said outer chamber 20 having a larger diameter than, and coaxially positioned to, said inner chamber 18.

At the bottom of said outer chamber 20 are one or more apertures 22 which allow an additive to drain into a mixing area, often a washing machine tub.

Figure 2:
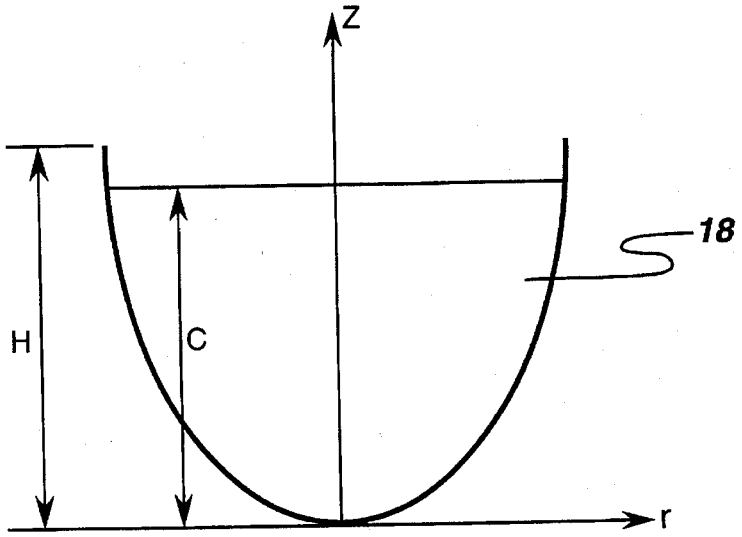
FIG. 2 illustrates the hydrostatic design parameters for the instant invention.

Said inner chamber 18 has a parabolic shape and is defined by the following parameters, as shown in FIG. 2:

$$shape—Z=(\Omega^2 r^2)/2g$$

$$fill\ level—c=\Omega[v_c/(\pi g)]^{+e,fra\ 1/2}+ee$$

$$height—H^2\approx c^2]1-(w^2/\Omega^2)]^{-1};$$

wherein, $\Omega$ is equal to the design angular speed (radians/seconds) set less than or equal to the spin speed of the washer and greater than or equal to the peak agitation speed of the washer; $v_c$ is the inner chamber's volumetric capacity; g is the gravitational force; r is the radius of the parabolic cup at a given height Z; c is the height of the fill level; and w is the peak angular speed (radians/second) of agitation.

During operation, said dispenser cup 10 functions as follows. During a spin phase of a washing unit, centrifugal force causes an additive which has been placed within the inner chamber 18 of the dispenser cup 10, to completely flow out of the parabolic shaped inner chamber 18 and into the outer chamber 20. Once in the outer chamber 20, the additive continues to flow under the influence of centrifugal force about the inner surface of the outer chamber 20. When the spin phase ends, the additive flows by gravity out of the aperture(s) 22 at the bottom of the outer chamber 20 and into a washing machine tub as said tub is filling with rinse water.

Figure 3:
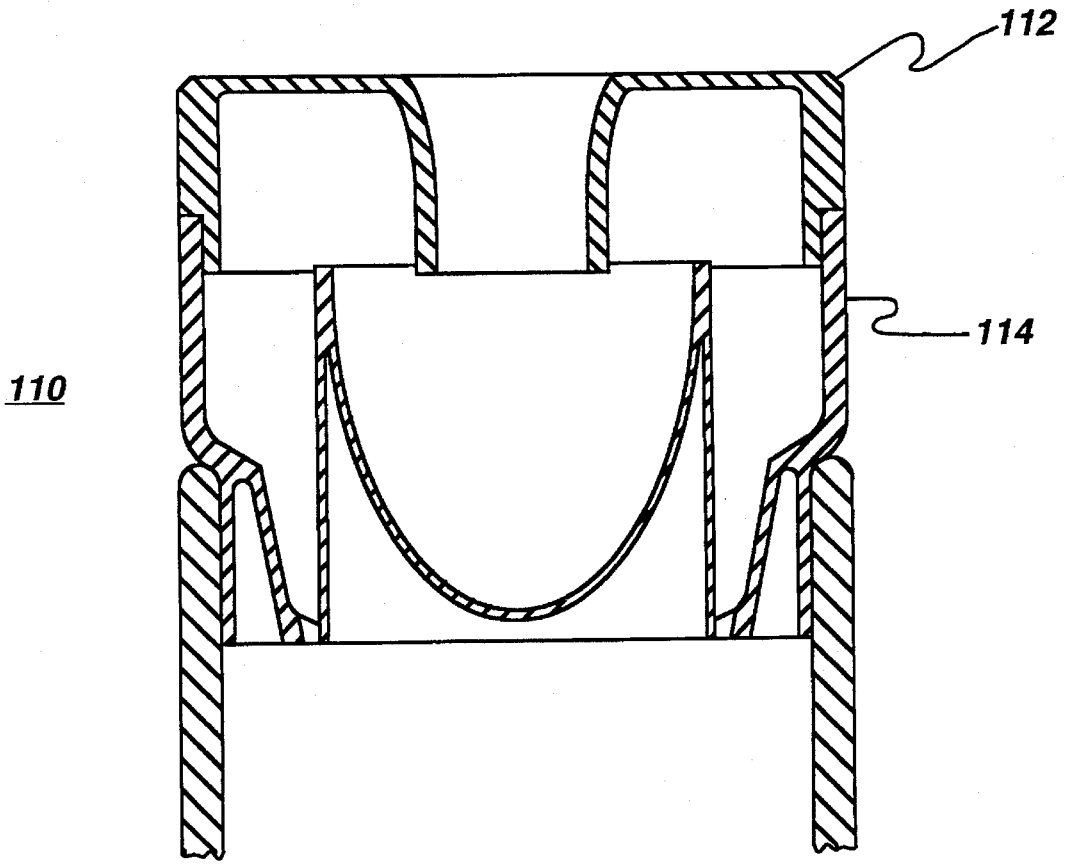
FIG. 3 illustrates a cross-sectional view along the vertical axis of a thin walled, readily moldable alternative embodiment of the instant invention.

FIG. 3 depicts an alternative embodiment 110 in which said top cap 112 and said bottom cup 114 would have a thin walled, readily moldable design which would require the part thickness of the bottom cup 114 and the top cap 112 to be nearly uniform. This would allow the dispenser cup 110 to be readily cooled during manufacturing.

Figure 4:
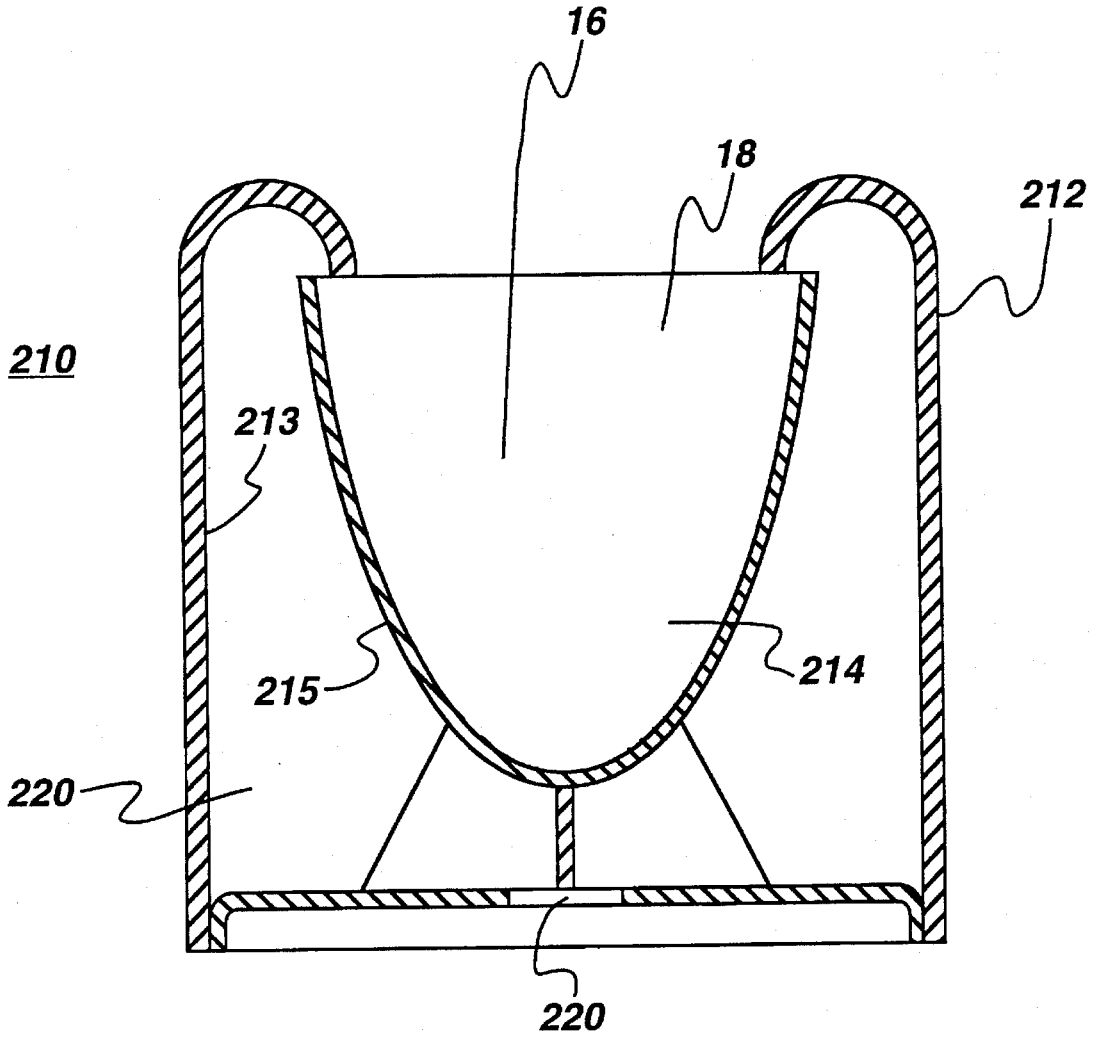
FIG. 4 illustrates a cross-sectional view along the vertical axis of an alternative embodiment of the instant invention.

FIG. 4 depicts an alternative embodiment 210 in which said top cap 212 is fixedly positioned over said bottom cup 214 wherein the outer surface 215 of said bottom cup 214 and the inner surface 213 of said top cap 212 define said outer chamber 220. Furthermore, a central hole 220 or a ring of radially dispersed holes may be provided in the bottom cup to dispense laundry additive once the cup stops spinning.

While the preferred embodiment of the present invention has been illustrated and described herein, it will be apparent to those skilled in the art that various modifications thereto can be made without departing from the spirit and scope of the invention as defined in the appended claims.

What is claimed is:

1. A dispenser cup for use within a washing machine having a design angular speed, a spin speed, a peak agitation speed and a peak angular speed of agitation, comprising:

a top cap having an inlet;

said top cap fixedly positioned above a bottom cup, wherein said inlet fluidly connects said top cap to said bottom cup;

said bottom cup comprising an inner chamber capable of holding an additive and an outer chamber having a bottom;

said outer chamber having a larger diameter than said inner chamber, and said outer chamber coaxially positioned to said inner chamber;

said outer chamber having one or more apertures therein, wherein said apertures are located at the bottom of said outer chamber, to dispense said additive;

said inner chamber having a parabolic shape defined by the following equations:

$$shape—Z=(\Omega^2 r^2)/2g;$$

$$fill\ Level—c=\Omega[v_c/(\pi g)]^{1/2};$$

$$height—H^2\approx c^2[1-(w^2/\Omega^2)]^{-1};$$

wherein, $\Omega$ is equal to the design angular speed (radians/second) set less than or equal to the spin speed and greater than or equal to the peak agitation speed; $v_c$ is the inner chamber's volumetric capacity; g is the gravitational force; r is the radius of the inner chamber at a given height Z; c is the height of the fill level; and w is the peak angular speed (radians/second) of agitation.

2. A dispenser cup in accordance with claim 1, wherein said top cap and said bottom cup are made from plastic.

3. A dispenser cup in accordance with claim 1, wherein said top cap and said bottom cup are made from polypropylene.

4. A dispenser cup in accordance with claim 1, wherein said top cap and said bottom cup have a uniform wall thickness.

5. A dispenser cup in accordance with claim 1, wherein said top cap and said bottom cup are thin- walled.

6. A dispenser cup for use within a washing machine having a design angular speed, a spin speed, a peak agitation speed and a peak angular speed of agitation, comprising:

a top cap having an inlet;

said top cap fixedly positioned above a bottom cup, wherein said inlet fluidly connects said top cap to said bottom cup;

said bottom cup comprising an inner chamber capable of holding an additive and an outer chamber having a bottom;

said outer chamber having a larger diameter than said inner chamber, and said outer chamber coaxially positioned to said inner chamber;

said outer chamber having a central hole or a ring of radially dispersed holes located at the bottom of said outer chamber to dispense said additive;

said inner chamber having a parabolic shape defined by the following equations:

$$shape—Z=(\Omega^2 r^2)/2g;$$

*fill Level*—$c=\Omega[v_c/(\pi g)]^{1/2}$;

*height*—$H^2 \approx c^2[1-(w^2/\Omega^2)]^{-1}$;

wherein, $\Omega$ is equal to the design angular speed (radians/second) set less than or equal to the spin speed and greater than or equal to the peak agitation speed; $v_c$ is the inner chamber's volumetric capacity; g is the gravitational force; r is the radius of the inner chamber at a given height Z; c is the height of the fill level; and w is the peak angular speed (radians/second) of agitation.

* * * * *